US008430465B2

(12) United States Patent
Nakayama

(10) Patent No.: US 8,430,465 B2
(45) Date of Patent: Apr. 30, 2013

(54) PRINT HEAD CONTROL DEVICE IN INK JET PRINTER

(75) Inventor: Sadatsugu Nakayama, Kisaradu (JP)

(73) Assignee: Kabushiki Kaisha Tokyo Kikai Seisakusho (JP)

( * ) Notice: Subject to any disclaimer, the term of this patent is extended or adjusted under 35 U.S.C. 154(b) by 54 days.

(21) Appl. No.: 13/205,035

(22) Filed: Aug. 8, 2011

(65) Prior Publication Data

US 2012/0086746 A1 Apr. 12, 2012

(30) Foreign Application Priority Data

Oct. 6, 2010 (JP) ..... 2010-226174

(51) Int. Cl.
*B41J 29/38* (2006.01)

(52) U.S. Cl.
USPC ..... 347/9; 347/13; 347/42

(58) Field of Classification Search ..... 347/5, 9, 347/12, 13, 40, 42
See application file for complete search history.

(56) References Cited

U.S. PATENT DOCUMENTS

| | | | | |
|---|---|---|---|---|
| 6,976,102 | B1 * | 12/2005 | Groen et al. | 710/72 |
| 7,493,543 | B1 * | 2/2009 | Wu et al. | 714/738 |
| 7,535,254 | B1 * | 5/2009 | Case | 326/39 |
| 7,557,607 | B1 * | 7/2009 | Tran et al. | 326/39 |
| 2006/0098036 | A1 | 5/2006 | Gardner | |
| 2008/0036801 | A1 | 2/2008 | Mihara | |

FOREIGN PATENT DOCUMENTS

| | | |
|---|---|---|
| JP | 2000-079728 | 3/2000 |
| JP | 2002-273950 | 9/2002 |
| JP | 2005-007582 | 1/2005 |
| JP | 2006-289648 | 10/2006 |
| JP | 2007-069364 | 3/2007 |
| JP | 2010-125630 | 6/2010 |

OTHER PUBLICATIONS

Kyocera Corporation; "Kyocera Printing Solution General Catalogue"; 2009; pp. 7-8; Japan.

* cited by examiner

*Primary Examiner* — Juanita D Jackson
(74) *Attorney, Agent, or Firm* — Clark Hill PLC

(57) ABSTRACT

A print head control device 4 in an ink jet printer IJP includes a print head drive board 42*c*3, a PCIe, and an image processing computer 42*c*. The print head drive board 42*c*3 is configured by a circuit between the PCIe and the print head drive board 42*c*3,the circuit having an interface function and a print head drive function integrated therein. This circuit includes an FPGA configured to perform a rearrangement processing such that assigned page data is matched to alignment of print heads 50. Further, a device driver 42*c*7 which is control software for the print head drive board 42*c*3 performs an internal transfer processing of the assigned page data to the print head drive board 42*c*3.

1 Claim, 3 Drawing Sheets

PRINT HEAD CONTROL DEVICE IN INK JET PRINTER

CROSS-REFERENCE TO RELATED APPLICATIONS

The present application relates to subject matter contained in Japanese Patent Application No. 2010-226174, filed on Oct. 6, 2010, all of which is expressly incorporated herein by reference in its entirety.

BACKGROUND OF THE INVENTION

1. Field of the Invention

The present invention relates to a print head control device in an ink jet printer configured to perform single-pass printing.

2. Description of the Related Art

Conventionally known is an ink jet printer configured to jet ink onto paper by means of heat or pressure and thereby print on the paper. Moreover, proposed as an ink jet printer of this kind, in place of a conventional large-scale industrial high-speed printer such as an offset printer, is a device comprising a plurality of print heads for realizing high quality and high-speed printing (refer to, for example, Patent Documents 1 and 2 below)

Known in such conventional ink jet printers is a device in which a plurality of print heads are arranged staggered along a direction that is perpendicular to a moving direction of a printing paper and along an entire width of the printing paper, and in which timing is matched to the printing paper moving beneath the print heads to perform printing by discharging ink from the plurality of print heads, that is, a device that performs printing at high speed by the so-called single-pass system.

Moreover, known as a means of performing four-color printing utilizing an ink jet printer configured to perform printing by such a single-pass system is the disposing of four colors of print head groups, each extending along an overall width of the printing paper, at certain intervals in the direction that the printing paper moves, the four colors being cyan, magenta, yellow, and black (C•M•Y•K) (refer to, for example, Patent Document 3 below).

On the other hand, when printing is performed by the ink jet printer, page data produced by a master system is downloaded to a master control computer, and, after undergoing the following processing beforehand in the master control computer, namely RIP (Raster Image Processing) processing, four-color separation processing, ink jet conversion processing (four-level gradation processing), and, furthermore, imposition processing performed after combination in jobs, is stored in the master control computer. Then, when printing is started, a job is selected, and processing-completed page data to be printed is retrieved from the master control computer to be sent to a print head control device.

In the print head control device, page data is received by an image processing computer, and, in the image processing computer, the received page data undergoes rearrangement processing corresponding to the staggered alignment of print heads in each color of the print head groups by an application program, to be temporarily saved in memory. The page data is temporarily saved in memory, a ready-to-print state is achieved, movement of the printing paper commences, a drive signal is outputted from the print head control device to the print heads, and printing begins (refer to, for example, Patent Document 4 and Non-Patent Document 1 below).

[Patent Document 1] JP 2005-7582 A
[Patent Document 2] JP 2007-69364 A
[Patent Document 3] JP 2006-289648 A
[Patent Document 4] JP 2002-273950 A
[Non-Patent Document 1] "KYOCERA Printing Solution General Catalogue" (issued 2009 by KYOCERA Corporation), pages 7 and 8, Ink Jet Print Heads

SUMMARY OF THE INVENTION

Conventionally, a method has been adopted in which the page data that has been four-color separated subsequent to the RIP processing undergoes the rearrangement processing by means of the application program of the image processing computer in order that said page data corresponds to the staggered alignment of print heads in the print head groups. Therefore, there was a problem that processing in the image processing computer prior to start of printing took a long time In addition, when printing of large volume data such as broadsheets or multiple pages is performed by single-pass printing, print heads configured to handle paper width for each of the inks are required. However, such print heads comprise an extremely large number of jet holes (nozzles), and, in order to handle these large numbers of nozzles, the rearrangement processing time for the page data becomes extremely long. Hence, to perform this processing rapidly to enable high-speed. printing, there was a need to either provide a high-speed specification image processing computer having an extremely fast processing time or to provide a plurality of image processing computers. However, in a method using such conventional technology, initial cost of the print, head control device increased, and, by extension, initial cost of the ink jet printer increased.

Particularly in the case of multi-color printing, since initial cost expands according to the number of colors of ink that are used, this cost could no longer be ignored.

The present invention was made in view of the above-mentioned problems faced by the conventional technology, and an object of the present invention is to provide an extremely low-cost print head control device capable of realizing high quality and high-speed printing in an ink jet printer.

To achieve the above-described object, a print head control device in an ink jet printer according to the present invention, the ink jet printer having a plurality of print heads provided so as to be aligned along a direction that is a direction perpendicular to a traveling direction of a printing paper and that is a width direction of the printing paper, each of the print heads including a plurality of nozzles for jetting ink, and the ink jet printer being configured capable of printing an image based on assigned page data, concurrently, along the width direction of the printing paper, includes: a print head drive board configured to drive the print heads to cause ink to be jetted from the nozzles; a PCIe (Peripheral Component Interconnect Express) ; and an image processing computer having a device driver installed therein, the device driver being software, the print head drive board being configured by a circuit between the PCIe and the print head drive board, the circuit having an interface function and a print head drive function integrated therein, the circuit configuring the print head drive board including an FPGA (Field Programmable Gate Array) configured to perform a rearrangement processing such that the assigned page data is matched to alignment of the print heads, and the device driver which is control software for the print head drive board performing an internal transfer processing of the assigned page data to the print head drive board.

The present invention allows the rearrangement processing of the page data performed by an application program of the image processing computer, and the internal page data transfer processing to be performed in real time while printing is being performed. The present invention hence removes the need for a waiting time due to image processing prior to start of printing, and thereby allows a reduction in printing time to be achieved, and productivity to be improved.

In addition, since the IC (Integrated Circuit) configuring the circuit of the print head drive board makes use of an FPGA (Field Programmable Gate Array), the present invention enables logic change subsequent to equipment delivery. The present invention having such a configuration allows logic to be always maintained in the latest required state without replacing the board.

Furthermore, the present invention allows the number of image processing computers to be kept to a minimum required, and hence makes it possible to provide an extremely low-cost print head control device capable of realizing high quality and high-speed printing in an ink jet printer, and, by extension, to provide an extremely low-cost ink jet printer,

DETAILED DESCRIPTION OF THE INVENTION

Preferred embodiments for carrying out the present invention are described below with reference to the drawings. The following embodiments are not intended to limit the inventions set forth in the claims, and the combinations of features described in the embodiments are not all necessarily indispensable for the means for solving the problem provided by the invention.

<Configuration of Ink Jet Printer Comprising Print Head Control Device>

Figure 1:
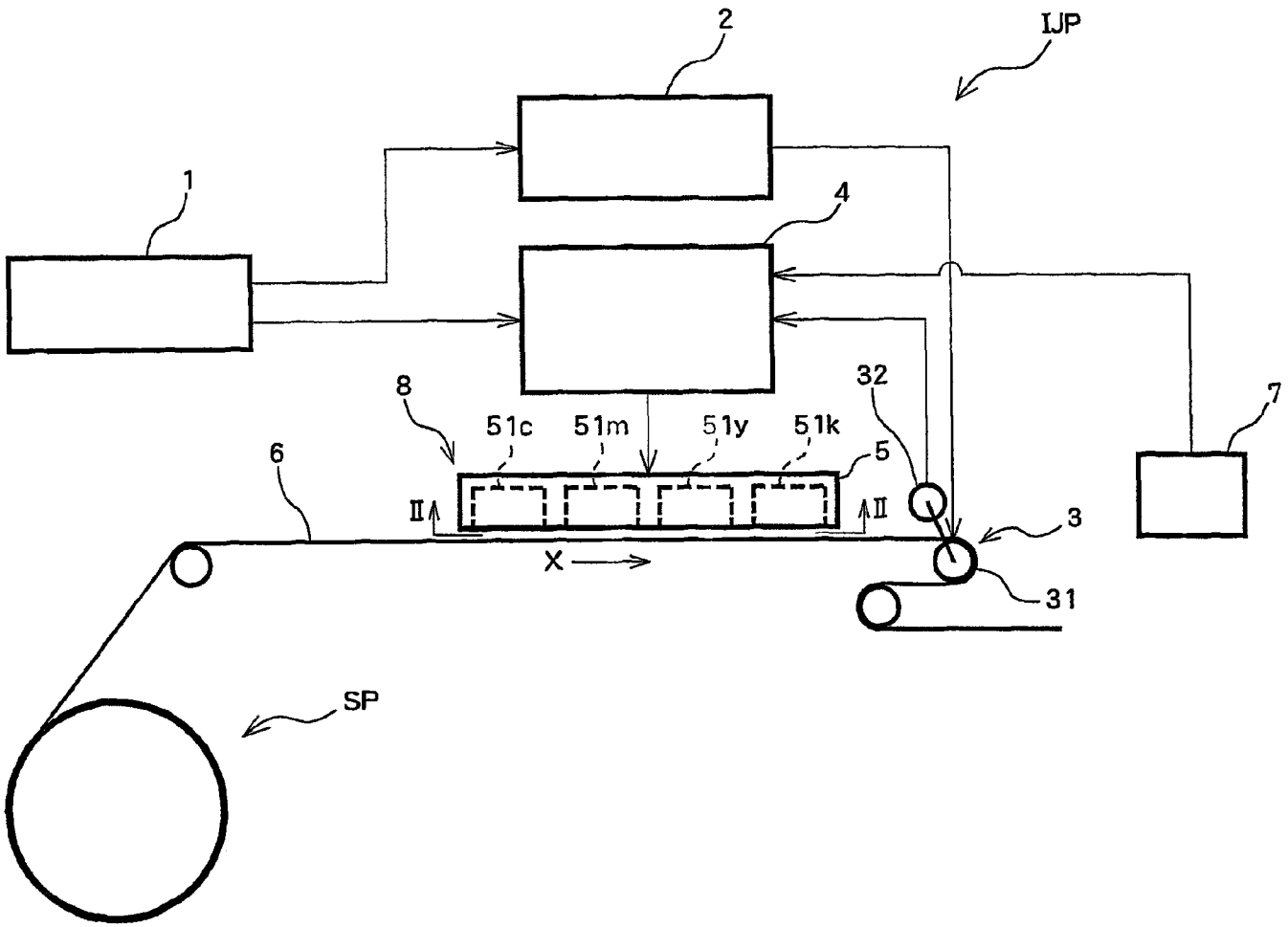
FIG. 1 is a view showing one configuration example of an ink jet printer comprising a print head control device according to a present embodiment.
Figure 2:
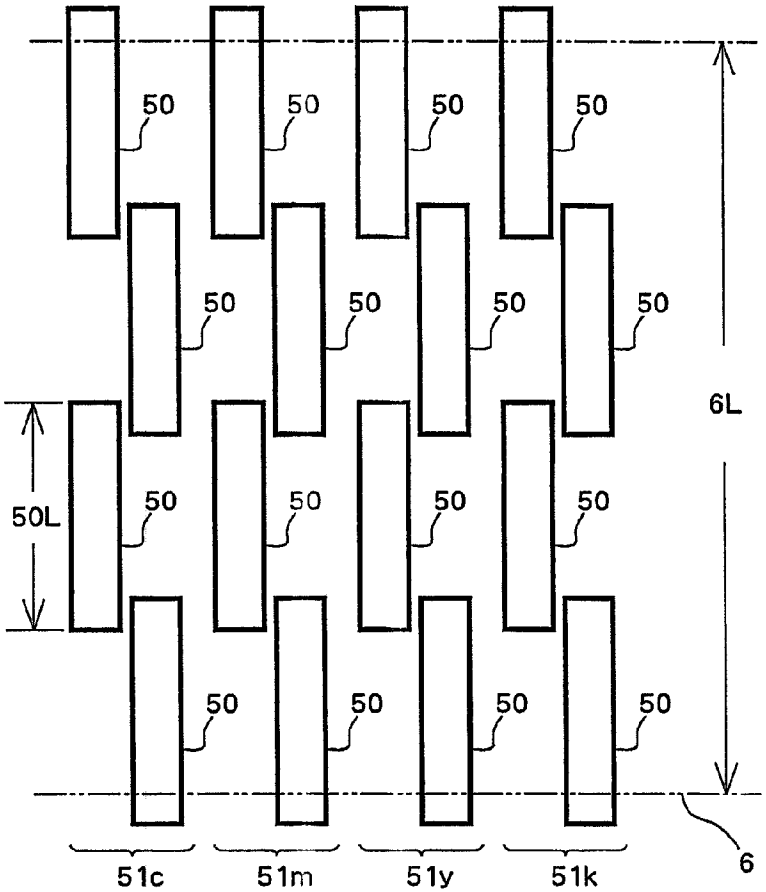
FIG. 2 is a view of a print head unit 5 in FIG. 1 taken along the line II-II of FIG. 1 and viewed in the direction of the arrows.

FIG. 1 is a view showing one configuration example of an ink jet printer IJP comprising a print head control. device 4 according to the present embodiment. In addition, FIG. 2 is a view of a print head unit 5 in FIG. 1 taken along the line II-II of FIG. 1 and viewed in the direction of the arrows.

The ink jet printer IJP includes: a paper feeding device SP capable of feeding a printing paper 6 toward a downstream side, the printing paper being continuous; a printing device 8 comprising the print head unit 5 for performing ink jet printing on the printing paper 6; a paper conveying unit 3 configured to send forth the printed printing paper 6 to the downstream side by means of a rotary driven roller 31 driven to rotate; and a post-processing device 7 configured to cut, or out and fold the printed printing paper 6. Provided alongside the rotary driven roller 31 is an encoder 32 that outputs a pulse signal every certain rotation amount of the rotary driven roller 31.

The print head unit 5 comprises print head groups 51*c*, 51*m*, 51*y*, 51*k* for each of different inks, the print head groups 51*c*, 51*m*, 51*y*, 51*k* each being provided having a plurality of print heads 50 disposed along a width direction of the printing paper 6, each of the print heads 50 having a length dimension 50L smaller than a width dimension 6L of the printing paper 6. Each of the print heads 50 disposed along the width direction of the printing paper 6 has a plurality of nozzles for discharging ink arranged on a portion of the print head 50 facing the printing paper 6, along at least the width direction of the printing paper 6. Moreover, connected to the print head unit 5 is a print head control device 4 configured to control the print head unit 5.

The print head control device 4 is connected to a master control computer 1. This master control computer 1 comprises a function to perform an RIP processing of inputted printing data, a function to perform a gradation conversion processing, a function to perform an imposition processing, a job operation function for setting print copy number and single-side/double-side printing, a function to manage a schedule of ready-to-print jobs, a function to control the ink jet printer IJP, and a function to display printing status. The master control computer 1, as well as being connected to the print head control device 4, is also connected to a printer control unit 2 configured to control operation of each of devices of the ink jet printer IJP except the print head unit 5. Note that in FIG. 1, arrow X indicates a moving direction of the printing paper 6

<Configuration of Print Head>

As shown in detail in FIG. 2, the print head unit 5 is provided with four color's worth of print head groups, namely, a cyan ink print head group 51*c*, a magenta ink print head group 51*m*, a yellow ink print head group 51*y*, and a black ink print head group 51*k*. Moreover, each of the print head groups 51*c*, 51*m*, 51*y*, 51*k* comprises four print heads 50, 50, 50, 50 disposed staggered with respect to each other, Note that in the present invention, a number of print heads 50 configuring each of the print head groups 51*c*, 51*m*, 51*y*, 51*k* is of course not limited to four, and a disposition of the print heads 50 is also of course not limited to being a staggered disposition.

<Configuration of Print Head Control Device>

Figure 3:
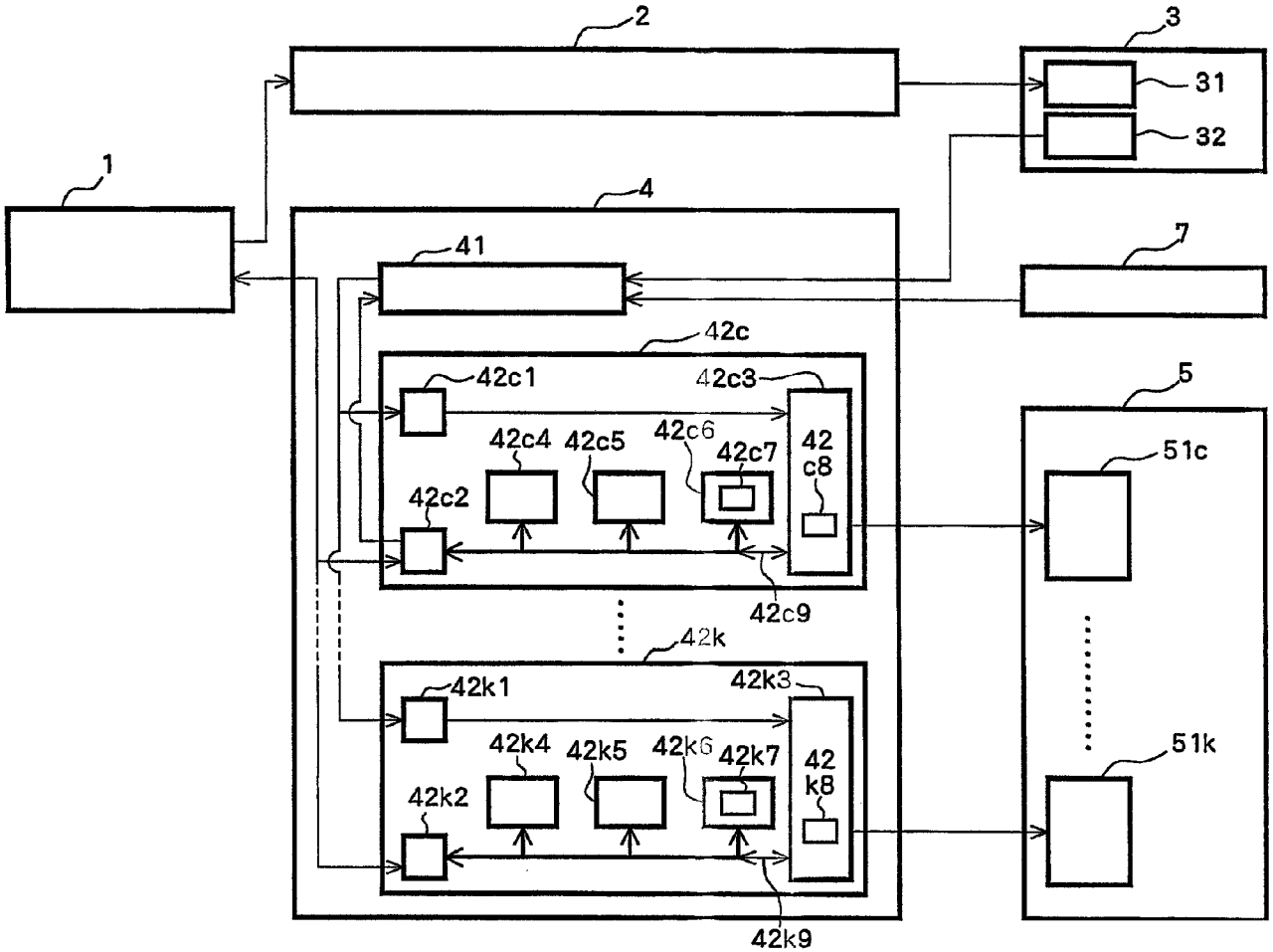
FIG. 3 is a block diagram showing a configuration of a print head control device 4.

FIG. 3 is a block diagram showing a configuration of the print head control device 4. The print head control device 4 comprises: a timing generation unit 41; and image processing computers 42*c*, 42*m*, 42*y*, 42*k* configured to control, respectively, the print head groups 51*c*, 51*m*, 51*y*, 51*k*, that is, an image processing computer 42*c* configured to control the cyan ink print head group 51*c*, an image processing computer 42*m* configured to control the magenta ink print head group 51*m*, an image processing computer 42*y* configured to control the yellow ink print head group 51*y*, and an image processing computer 42*k* configured to control the black ink print head group 51*k*. Note that to avoid complication of the diagram, the two image processing computers 42*y*, 42*m* in the print head control device 4 are omitted from FIG. 3. Moreover, all of the image processing computers 42*c*, 42*m*, 42*y*, 42*k* have an identical configuration and an identical connection configuration, hence, in the following description of the image processing computers 42*c*, 42*m*, 42*y*, 42*k*, the image processing computer 42*c* configured to control the cyan ink print head group 51*c* is described, and description of the other three image processing computers 42*m*, 42*y*, 42*k* is kept to mentioning only representative symbols in brackets.

Inputted to the timing generation unit 41 are, respectively, an encoder pulse from the paper conveying unit 3, and a continuous paper cutting timing signal, continuous paper folding position signal, and so on, from the post-processing device 7 The timing generation unit 41 produces various kinds of drawing timing signals for controlling timing of drawing based on these inputs, and outputs the produced various kinds of drawing timing signals toward a print head drive board 42*c*3 (42*m*3, 42*y*3, 42*k*3) of the image processing computer 42*c* (42*m*, 42*y*, 42*k*) to be described later, The image processing computer 42*c* (42*m*, 42*y*, 42*k*) comprises: a pulse distribution board 42*c*1 (42*m*1, 42*y*1, 42*k*1) ; an interface unit 42c2 (42m2, 42y2, 42k2); a print head drive board 42c3 (42m3, 42y3, 42k3); a central processing unit 42c4 (42m4, 42y4, 42k4); a memory 42c5 (42m5, 42y5, 42k5); and a hard disk 42c6 (42m6, 42y6, 42k6)

The pulse distribution board 42c1 (42m1, 42y1, 42k1) is connected to the timing generation unit 41. The interface unit 42c2 (42m2, 42y2, 42k2) is a download interface and is connected to the master control computer in order to download page data that has undergone separation processing into various colors by the master control computer 1, to the image processing computer 42c (42m, 42y, 42k) The hard disk 42c6 (42m6, 42y6, 42k6) temporarily stores (spools) the page data downloaded from the master control computer 1 in a waiting state. The memory 42c5 (42m5, 42y5, 42k5) is a buffer, and is configured to sequentially extract the page data temporarily stored in the hard disk 42c6 (42m6, 42y6, 42k6), and send said page data to the print head drive board 42c3 (42m3, 42y3, 42k3). The print head drive board 42c3 (42m3, 42y3, 42k3) adopts a configuration in which the following functions, namely a function of a PCIe (Peripheral Component interconnect Express) board to perform an interface between a PCIe (Peripheral Component Interconnect Express) 42c9 (42m9, 42y9, 42k9) and a peripheral device of a computer, and a function of a drive board for print, heads, are integrated in a single board. In addition, the print head drive board 42c3 (42m3, 42y3, 42k3) uses an FPGA (Field Programmable Gate Array) 42c8 (42m8, 42y8, 42k8) in a circuit configuring the print head drive board 42c3 (42m3, 42y3, 42k3). Moreover, the print head drive board 42c3 (42m3, 42y3, 42k3) comprises a device driver 42c7 (42m7, 42y7, 42k7) which is control software for the print head drive board 42c3 (42m3, 42y3, 42k3) Furthermore, the print head drive board 42c3 (42m3, 42y3, 42k3) is connected to the print head group 51c (51m, 51y, 51k) to enable each of the print heads 50 to be driven. The central processing unit 42c4 (42m4, 42y4, 42k4) performs all of control of the image processing computer 42c (42m, 42y, 42k).

<Operation Due to Above-Described Configuration>

Page data inputted to and stored in the master control computer 1 undergoes four-color separation processing by RIP processing, and gradation conversion processing in the master control computer 1. In the present embodiment, a gradation conversion processing into four gradations is performed. Furthermore, the converted page data undergoes imposition processing in accordance with page configuration in input-specified job information relating to the page data. Page layout information required in the imposition processing is produced in the master control computer 1. Job information linked to page data for which imposition processing has been completed is recorded in a list of ready-to-print jobs in the master control computer 1, and at the same time, the page data that has undergone imposition processing is saved and managed as processing-completed-page-data-for-printing in the master control computer 1, whereby printing-readiness is completed.

After printing-readiness has been completed, printing is started. That is, an instruction of printing start is outputted via the master control computer 1. More specifically, the master control computer 1 selectively specifies job information of the job to be printed on this occasion from among the job information recorded in the ready-to-print job list, this selective specification being performed from an input unit (not shown) included in the master control computer 1 itself Then, the instruction of printing start is outputted from the master control computer 1 and sent to the printer control unit 2. As a result, the printer control unit 2 starts control and the ink jet printer LIP commences operation.

The ink jet printer IJP commencing operation causes the rotary driven roller 31 of the paper conveying unit 3 to start rotating, whereby the printing paper 6 is sent forth in the X direction, and a pulse signal (speed signal) corresponding to a printing speed (that is, a moving speed of the printing paper 6) is outputted from the encoder 32 provided alongside the rotary driven roller 31. In addition, a means for cutting the printing paper 6 (not shown) included in the postprocessing device 7 commences operation, and the continuous paper cutting timing signal corresponding to a timing for cutting the printing paper 6 is outputted. Then, these signals are outputted to the timing generation unit 41 of the print head control device 4. Moreover, the timing generation unit 41 is connected to the master control computer 1 via the interface unit 42c2 of the image processing computer 42c, and receives job information common to printing pages executed by the four inks such as page size and so on from the master control computer 1. The timing generation unit 41, having received these signals, produces the various kinds of drawing timing signals in the width direction of the printing paper 6, based on the speed signal from the encoder 32 and the continuous paper cutting timing signal from the post-processing device 7, and sends said various kinds of drawing timing signals to the pulse distribution board 42c1 (42m1, 42y1, 42k1). The pulse distribution board 42c1 (42m1, 42y1, 42k1) sends the drawing timing signals received from the timing generation unit 41 to the print head drive board 42c3 (42m3, 42y3, 42k3).

On the other hand, the master control computer 1 sends page data to each color of image processing computer 42c (42m, 42y, 42k) in the print head control device 4, on the basis of selectively specified job management information.

Each color of image processing computer 42c (42m, 42y, 42k) temporarily stores (spools) the printing page data, received from the master control computer 1 via the interface unit 42c2 (42m2, 42y2, 42k2), in the hard disk 42c6 (42m6, 42y6, 42k6). This is to adjust a time difference between a processing speed of the image processing computer 42c (42m, 42y, 42k) and a drawing operation speed of the print heads 50, 50, 50, 50. Next, each color of image processing computer 42c (42m, 42y, 42k), while sequentially extracting said printing page data from the hard disk 42c6 (42m6, 42y6, 42k6), stores said printing page data in the memory 42c5 (42m5, 42y5, 42k5) used as a data buffer, and sends forth said printing page data sequentially to the print head drive board 42c3 (42m3, 42y3, 42k3) This series of transfer processings of the printing page data inside the image processing computer 42c (42m, 42y, 42k) is executed in real time without placing any burden on operation of the central processing unit 42c4 (42m4, 42y4, 42k4), due to the fact that the following functions, namely the function of a PCIe (Peripheral Component Interconnect Express) board to perform an interface between the PCIe (Peripheral Component Interconnect Express) 42c9 (42m9, 42y9, 42k9) and a peripheral device of a computer, and the function of a drive board for print heads, are integrated to configure a single board, and due to the fact that the instruction is issued from the device driver 42c7 (42m7, 42y7, 42k7) for the print head drive board 42c3 (42m3, 42y3, 42k3). Then, the image processing computer 42c (42m, 42y, 42k) performs conversion processing to convert the printing page data, sent to the print head drive board 42c3 (42m3, 42y3, 42k3) from that memory 42c5 (42m5, 42y5, 42k5), in real time, to a format for actually driving the print heads, by means of the FPGA (Field Programmable Gate Array) 42c8 (42m8, 42y8, 42k8) in the print head drive board 42c3 (42m3, 42y3, 42k3). This conversion processing of the printing page data is the rearrangement processing of the printing page data corresponding to the staggered alignment of the print, heads 50, 50, 50, 50 in each color of print head group 51*c* (51*m*, 51*y*, 51*k*) Furthermore, the image processing computer 42*c* (42*m*, 42*y*, 42*k*) converts the printing page data that has undergone conversion processing to the format for actually driving the print heads to a print head drive signal in the print head drive board 42*c*3 (42*m*3, 42*y*3, 42*k*3), and then synchronizes this print head signal with the drawing timing signal sent from the timing generation unit 41, and sends it to each of print heads 50, 50, 50, 50 in the print head group 51*c* (51*m*, 51*y*, 51*k*)

In each of print heads 50, 50, 50, 50 to which the print head drive signal has been sent, the nozzle operates according to the print head drive signal and ink is discharged from the nozzle toward the printing page 6, thereby performing drawing.

Meanwhile, after operation start of the ink jet printer IJP, the printer control unit 2, having received the instruction of printing start from the master control computer 1, controls operation of the paper conveying unit 3 and the post-processing device 7, and so on, such that the operation speed of the ink jet printer IJP is raised to an ordinary operation speed, in parallel with the drawing based on control of the print head control device 4. Moreover, along with drawing start, the central processing unit 42*c*4 (42*m*4, 42*y*4, 42*k*4) in the image processing computer 42*c* (42*m*, 42*y*, 42*k*) starts a calculation of a number of copies left to print by subtraction of a number of already-printed copies from the set print copy number in the job information from the master control computer 1. Then, when the print copy number has reached a previously set certain number before becoming "0 (zero)", the image processing computer 42*c* (42*m*, 42*y*, 42*k*) outputs a first notification signal notifying to that effect to the master control computer 1. The master control computer 1, having received the first notification signal from the image processing computer 42*c* (42*m*, 42*y*, 42*k*), outputs a speed reduction instruction urging speed reduction control of the ink jet printer IJP to the printer control unit 2. The printer control unit 2, having received the speed reduction instruction from the master control computer 1, starts speed reduction control of the operation speed of the ink jet printer IJP. In addition, when the number of copies left to print becomes "0 (zero)", the image processing computer 42*c* (42*m*, 42*y*, 42*k*) outputs a second notification signal notifying to the effect that the print copy number has become "0 (zero)" to the master control computer 1. The master control computer 1, having received the second notification signal from the image processing computer 42*c* (42*m*, 42*y*, 42*k*), issues a stop instruction stopping the ink jet printer IJP to the printer control unit 2, and a drawing operation stop instruction stopping the drawing operation by the print heads 50, 50, 50, 50 to the print head control device 4. The printer control unit 2, having received the stop instruction from the master control computer 1, stops operation of the ink jet printer IJP, and, furthermore, the print head control device 4, having received the drawing operation stop instruction from the master control computer 1, stops the drawing operation by the print heads 50, 50, 50, 50, whereby control of printing in the ink jet printer IJP stops.

The rearrangement processing of the page data, and the internal page data transfer processing as in the above-mentioned embodiment can be performed in real time while printing is being performed. Hence, the need for a waiting time due to image processing prior to start of printing is removed, thereby allowing a reduction in printing time to be achieved, and productivity to be improved.

Moreover, in the above-mentioned embodiment, the image processing computer 42*c* (42*m*, 42*y*, 42*k*) can execute processing of the printing page data in real time while retaining a residual processing capability in the central processing unit 42*c*4 (42*m*4, 42*y*4, 42*k*4). Hence, the above-mentioned embodiment allows the number of image processing computers 42*c* (42*m*, 42*y*, 42*k*) to be kept to a minimum required, and makes it possible to provide an extremely low-cost print head control device 4 capable of realizing high quality and high-speed printing in the ink jet printer IJP. Therefore, utilizing the image processing computer 42*c* (42*m*, 42*y*, 42*k*) of the present embodiment makes it possible to provide an extremely low-cost ink jet printer IJP.

Preferred embodiments of the present invention have thus been described, but the technical scope of the present invention is not limited to the scope of description in the above embodiments. Various changes or improvements can be made to the above embodiments For example, a configuration may be adopted in which each print head group 51*c* (51*m*, 51*y*, 51*k*) in the printing device 8 is provided with a USB (Universal Serial Bus) connector, thereby enabling firmware and logic of the FPGA 42*c*8 (42 42*y*8, 42*k*8) to be easily changed. Due to the fact that logic can be changed subsequent to equipment delivery, utilizing the USB connector allows logic to be always maintained in the latest required state without replacing the board, is thus highly preferable. Note that this configuration providing the USB connector further makes it possible to perform detection of transfer error information of the page data and monitoring of temperature or current of heads, for example, and is therefore extremely useful.

It is clear from the descriptions in the claims that embodiments including such changes or improvements can also be included in the technical scope of the present invention.

The present invention may be utilized in a print head control device of an ink jet printer, the ink jet printer being capable of causing a continuous printing paper to move, while at the same time printing on an entire width of the printing paper by means of print heads provided along a width direction of the printing paper.

What is claimed is:

1. A print head control device in an inkjet printer, the ink jet printer having a plurality of print heads provided so as to be aligned along a direction that is a direction perpendicular to a traveling direction of a printing paper and that is a width direction of the printing paper, each of the print heads including a plurality of nozzles for jetting ink, and the ink jet printer being configured capable of printing an image based on assigned page data, concurrently, along the width direction of the printing paper, the print head control device in the ink jet printer including:

a print head drive board configured to drive the print heads to cause ink to be jetted from the nozzles;

a PCIe (Peripheral Component Interconnect Express); and an image processing computer having a device driver installed therein, the device driver being software, the print head drive board being configured by a circuit between the PCIe and the print head drive board, the circuit having an interface function and a print head drive function integrated therein, the circuit configuring the print head drive board including an FPGA (Field Programmable Gate Array) configured to perform a rearrangement processing such that the assigned page data is matched to alignment of the print heads, and the device driver which is control software for the print head drive board performing an internal transfer processing of the assigned page data to the print head drive board.

* * * * *